United States Patent [19]

Sartor

[11] Patent Number: 4,897,940

[45] Date of Patent: Feb. 6, 1990

[54] SKI BOOT WITH HEEL SECURING DEVICE

[75] Inventor: Mariano Sartor, Montebelluna, Italy

[73] Assignee: Nordica S.p.A., Montebelluna, Italy

[21] Appl. No.: 240,909

[22] Filed: Sep. 7, 1988

[30] Foreign Application Priority Data

Sep. 15, 1987 [IT] Italy ..... 82586 A/87

[51] Int. Cl.[4] ..... A43B 5/04

[52] U.S. Cl. ..... 36/119; 36/586; 36/121

[58] Field of Search ..... 36/117–121, 36/105, 50, 58.5, 58.6, 92

[56] References Cited

U.S. PATENT DOCUMENTS

| | | | |
|---|---|---|---|
| 4,203,235 | 5/1980 | Van Pelt, Jr. | 36/121 X |
| 4,447,970 | 5/1984 | Delery | 36/121 |
| 4,615,127 | 10/1986 | Delery | 36/117 |
| 4,724,625 | 2/1988 | Sartor | 36/117 |

FOREIGN PATENT DOCUMENTS

| | | | |
|---|---|---|---|
| 1811334 | 6/1970 | Fed. Rep. of Germany | 36/121 |
| 3527135 | 1/1987 | Fed. Rep. of Germany | 36/119 |
| 3721620 | 1/1988 | Fed. Rep. of Germany | 36/119 |

*Primary Examiner*—James K. Chi

*Attorney, Agent, or Firm*—Guido Modiano; Albert Josif

[57] ABSTRACT

The present invention relates to a rear-entry ski boot having a heel securing device and a shell to which at least one rear quarter is articulated. The peculiarity of the invention resides in that it comprises at least one wedge-like element interposed, at the skier's heel region, between the rear inner surface of said rear quarter and the skier's foot. Means actuatable by the skier are furthermore associated with the wedge-like element for its adjustment. The wedge-like element advantageously acts at a flap protruding from said shell or from a shoe internal to said boot.

18 Claims, 2 Drawing Sheets

Fig. 1
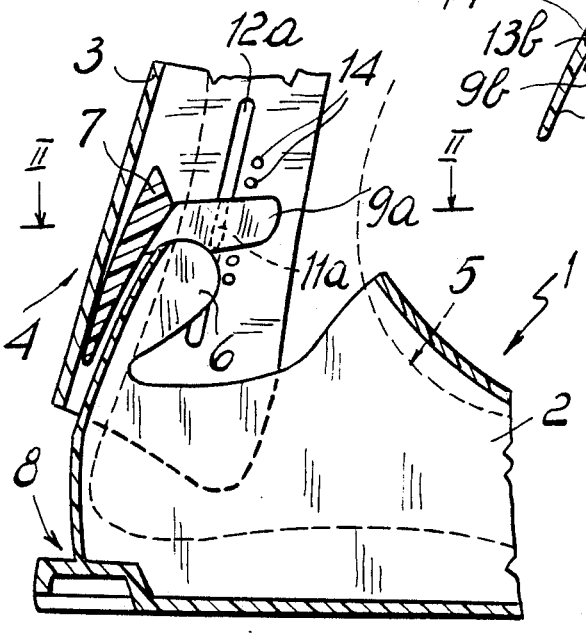
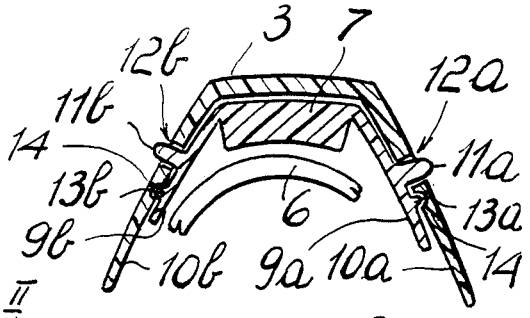
Fig. 2
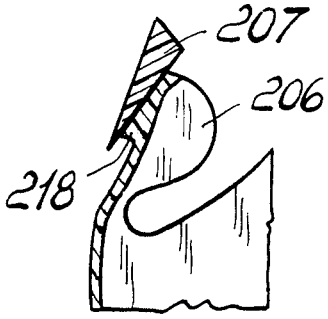
Fig. 5
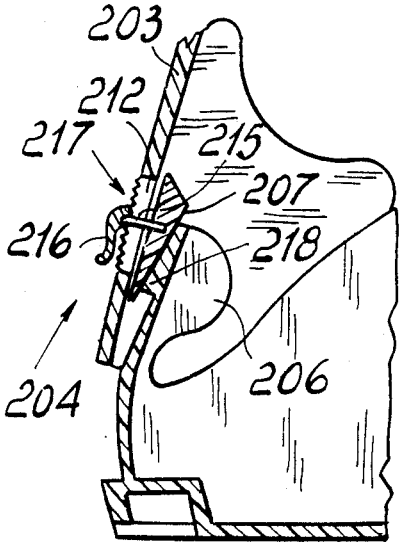
Fig. 6
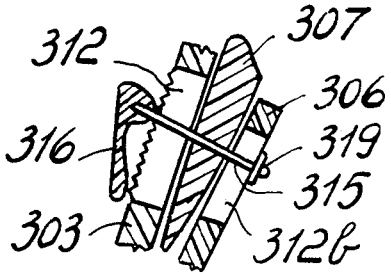
Fig. 7

SKI BOOT WITH HEEL SECURING DEVICE

BACKGROUND OF THE INVENTION

The present invention relates to a rear-entry ski boot with heel securing device.

Various devices are currently known which, applied to the boot, allow to secure the heel inside it.

For example, in the European patent No. 0158574 and in the German patent No. 2107659, a device is disclosed constituted by a knob rotatably associated rearwardly to the rear quarter of the boot which has, at the end of its threaded stem internal to the boot, a presser interacting with a flap protruding from the shell.

Said known type of device, however, has disadvantages: the actuation of the knob in fact leads to the exertion of a pressure on the flap which is concentrated at a very limited region constituted by the extension of the presser and arranged at a distance from the sole which remains substantially constant for any adjustment.

This arrangement makes the securing device difficult to adapt to the different anatomical configurations of the heel, possibly furthermore causing pain due to the concentration of pressure on a small area which may not be the optimum one for each individual skier.

Also known are devices comprising cables which partially embrace said flap protruding from the shell or from the shoe internal to the boot, such as for example the device disclosed in the U.S. patent application No. 4,620,378 in the name of the same Applicant.

However, these known devices also have the same disadvantages described above for the preceding devices.

As a partial solution to these disadvantages, U.S. Pat. No. 4,724,625 by this Applicant discloses a ski boot comprising an elongated element which extends transversely with respect to the longitudinal extension of the rear quarter of the ski boot, said elongated element being provided inside said rear quarter and substantially at the heel of the user's foot and being connected to the opposite longitudinal edges of said rear quarter.

Though said device is undoubtedly valid, it has the disadvantage that it yields under stress due to the sliding of the overlapping flaps; this causes a decrease of the degree of securing, especially during the flexing step in which it is most needed.

SUMMARY OF THE INVENTION

The aim of the present invention is therefore to eliminate the disadvantages described above in known types by providing a ski boot which allows to achieve the optimum securing of the heel inside said boot.

Within the above described aim, another important object is to provide a ski boot which allows to continuously regulate the pressure exertable at the heel.

Still another important object is to provide a boot wherein said adjustment can be executed in a rapid and simple manner by the user.

Not least object is to provide a boot which associates with the preceding characteristics that of being structurally very simple and of having extremely modest costs.

The above described aim and objects, as well as others which will become apparent hereinafter, are achieved by a rear-entry ski boot with heel securing device, comprising a shell with which there is articulated at least one rear quarter, characterized in that it comprises at least one wedge-like element interposed, at the skier's heel region, between the rear inner surface of said rear quarter and the skier's foot, with said wedge-like element there being associated means, actuatable by the skier, for its translatory motion.

Conveniently, the wedge-like element acts at a flap, protruding from said shell or from a shoe internal to said boot.

Advantageously, said adjustment of said wedge-like element occurs according to a translatory motion thereof along an axis longitudinal to said rear quarter.

BRIEF DESCRIPTION OF THE DRAWINGS

Further characteristics and advantages of the invention will become apparent from the detailed description of some embodiments, illustrated only by way of non-limitative example in the accompanying drawings, wherein:

FIG. 1 is a lateral section view of a boot provided with a device according to the invention;

FIG. 2 is a view taken along the sectional plane II—II of FIG. 1;

FIG. 5 is a partial view, similar to FIG. 1, of a device according to another aspect of the invention;

FIG. 6 is a view, similar to that of FIG. 3, of the means associated with the wedge-like element of FIG. 5 for its translatory motion with respect to the rear quarter;

FIG. 7 is a partial view, similar to FIG. 1, of a different embodiment of the invention;

DESCRIPTION OF THE PREFERRED EMBODIMENTS

Figure 3:
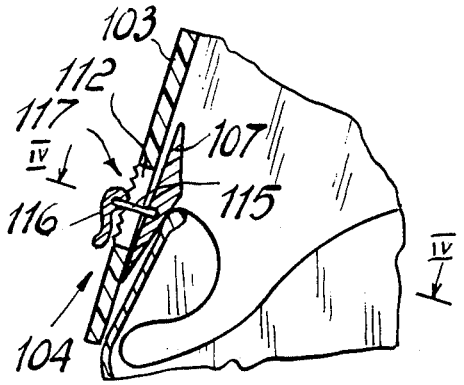
FIG. 3 is a view, similar to FIG. 1, illustrating the means associated with the wedge-like element for its translatory motion with respect to the rear quarter.
Figure 4:
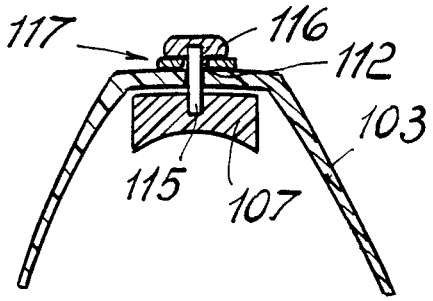
FIG. 4 is a view taken along the sectional plane IV—IV of FIG. 3.

With reference to the above described figures, the reference numeral 1 indicates a rear-entry ski boot composed of a shell 2 to which a rear quarter 3 is articulated.

At the rear region 4 of the heel of the foot 5 of the skier, the shell 2 has a flap 6 which protrudes upwardly from the shell and is elastically deformable and partially embraces said region 4.

The device comprises a wedge-like element 7 arrangeable between the inner surface of said rear quarter 3 and said flap 6 at the region 4 of the heel.

Said wedge-like element 7 has its apex directed towards the region of the heel 8 of the boot 1.

Laterally to the wedge-like element 7 there protrudes a pair of wings, indicated by the reference numerals 9*a* and 9*b*, which affect the inner lateral surfaces, respectively 10*a* and 10*b*, of the rear quarter 3.

From each of said wings there protrudes a pushbutton, indicated by the reference numerals 11*a* and 11*b*, which passes through the rear quarter 3 at adapted slots 12*a* and 12*b* provided longitudinally thereto.

Adjacent to the pushbuttons 11*a* and 11*b* there protrude, in the same direction, from said wings, raised portions 13*a* and 13*b* having a preferably hemispherical shape.

Said raised portions are selectively arrangeable at adapted shaped seats 14 provided at the inner lateral surfaces 10*a* and 10*b* of the rear quarter 3.

Said seats 14 are thus aligned substantially parallel to the slots 12*a* and 12*b*, and are in such a number as to allow a wide choice of positions for the wedge-like element 7.

The use of the device is as follows: by pressing the pushbuttons 11*a* and 11*b* the user imparts an elastic deformation to the wings 9*a* and 9*b*, disengaging the raised portions 13*a* and 13*b* from the seats 14, thus allowing the wedge-like element 7 to move along an axis approximately longitudinal to the rear quarter 3 along the slots 12*a* and 12*b*.

The skier can thus select the desired degree of securing, as the wedge-like element 7 creates a pressure on the flap 6 which is greater as it is lowered towards the region 8 of the heel of the boot.

Once the optimum position is chosen, the user releases the pushbuttons 11*a* and 11*b*, causing the raised portions 13*a* and 13*b* to affect one of the seats 14.

It has thus been observed that the invention achieves the abovementioned aim and objects, since the boot allows the skier to achieve the optimum securing of the heel inside the boot as well as the regulation of the pressure exertable thereat; in fact, as the securing degree increases, the region of the flap affected by the wedge-like element also increases, allowing to distribute the pressure exerted thereon on a greater area.

The actuation of the device is furthermore very rapid and easy for the skier, a variation of the securing of the heel being thus obtainable according to specific contingent situations.

Furthermore the device is structurally very simple, being therefore also economically advantageous.

Naturally the invention is susceptible to numerous modifications and variations, all within the scope of the same inventive concept.

Thus, for example, FIG. 3 illustrates variated means for the translatory motion of the wedge-like element 107 with respect to the rear quarter 103.

With the wedge-like element 107 there is in fact rigidly associated, or possibly articulated, a rod 115 passing at a slot 112 provided longitudinally to the rear quarter 103 at the heel region 104.

At the other end, said rod 115 is articulated to an eccentric lever 116 interacting with a set of teeth 117 provided transversely to the quarter 103 laterally to the slot 112.

Also in this embodiment it is therefore possible to move the wedge-like element 107 to the required position by acting directly at the eccentric lever 116.

In a further embodiment, the wedge-like element 207 interacts, at the surface directed towards the flap 206, provided on the shell and/or on the shoe internal to the boot, with a complementarily shaped tab 218 protruding rearwardly to said flap 206.

Said tab 218 thus has a surface inclined similarly to the facing surface of the wedge-like element 207.

With the element 207 it is possible to associate means for its translatory motion, such as those illustrated in FIG. 1 or those illustrated in FIG. 6, similar to those associated with the element illustrated in FIG. 3.

In said FIG. 6, in fact, with the wedge-like element 207 there is ridigly assocaited, and/or articulated, a rod 215 which protrudes through an adapted slot 212 provided longitudinally to the rear quarter 203 at the region 204 of the heel.

With the other end of the rod 215 there is articulated an eccentric lever 216 which affects an adapted set of teeth 217 provided transversely to the rear quarter 203 in a region adjacent to said slot 212.

The fact is stressed that by lowering the wedge-like element towards the heel of the boot an increasingly larger area of the flap provided on the shell and/or on the inner shoe is affected, thus improving the distribution of the pressure thereon.

This allows to maximally increase the comfort for the user, obtaining the optimum adaptation to the various anatomical configurations of each user.

FIG. 7 illustrates a device wherein the rod 315 affects the entire wedge-like element 307, its end passing at a first slot 312*a* and at a second slot 312*b* provided respectively longitudinally to the rear quarter 303 and to the flap 306 and facing each other.

Said rod is therefore, at the first slot 312*a*, articulated to the eccentric lever 316 and, at the second slot 312*b*, connected to a lug 319 protruding on the opposite side to the wedge-like element.

It is thus possible to open the flap when the boot is opened, i.e. when the quarters are spaced apart to extract the foot.

This allows a successive easier insertion of the foot without manually moving the flap as occurred previously.

Figure 8:
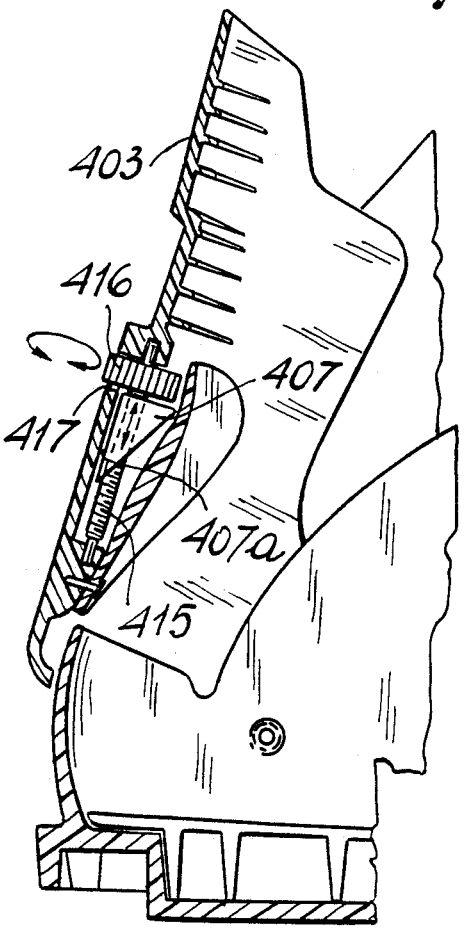
FIGS. 8 and 9 are sectional views, similar to FIG. 1, of a further embodiment in two different adjustment conditions.
Figure 9:
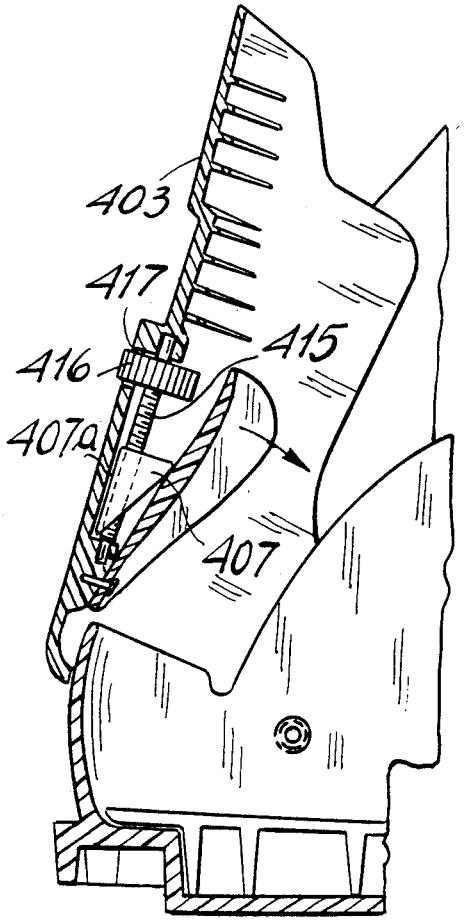

According to what is illustrated in FIGS. 8 and 9, the means for the translatory motion of the wedge-like element, now indicated by the reference numeral 407, are constituted by a threaded rod 415 which extends longitudinally on the quarter 403 and is rotatably supported by said quarter.

A knurled wheel 416, which protrudes partially by means of a port 417 defined by the quarter 403, is rigidly associated with one end of the rod 415.

The wedge-like element 407 has a through threaded seat which extends substantially parallel to its side 407*a* which engages by sliding contact with the inner face of the quarter 403, so as to prevent the possibility of rotation of the wedge-like element which is forced to move, consequently to the rotation of the threaded rod 415 executed by means of the wheel 416, parallel to said rod.

Naturally the materials and the dimensions and the individual components of the device may also be the most pertinent according to the specific requirements. reference signs.

I claim:

1. Rear-entry ski boot with heel securing device, comprising a shell with which there is articulated at least one rear quarter, comprising at least one wedge-like element interposed, at the skier's heel region, between the rear inner surface of said rear quarter and the skier's foot, with said wedge-like element there being associated means, actuatable by the skier, for its translatory motion, wherein said means for the translatory motion of said wedge-like element are constituted by a pair of elastically deformable wings, protruding laterally from said wedge-like element, said wings affecting the inner lateral surfaces of said rear quarter.

2. Boot according to claim 1, wherein from each of said wings there protrudes a pushbutton protruding externally to said rear quarter at adapted slots provided longitudinally thereto.

3. Boot according to claim 1, wherein from each of said wings there protrudes a pushbutton protruding externally to said rear quarter at adapted slots provided longitudinally thereto, proximate to said pushbuttons there protruding, from each of said wings, at least one raised portion, said at least one raised portion being removably arrangeable at adapted and complementarily shaped seats provided on said inner lateral surfaces of said rear quarter which are adjacent to said slots.

4. Boot according to claim 1, wherein said means for the transitory motion of said wedge-like element are constituted by a rod associated at one end with said wedge-like element, said rod passing at a slot provided longitudinally to said rear quarter on said heel region.

5. Boot according to claim 4, wherein said rod is articulated, at its outer end, to an eccentric lever interacting with a set of teeth provided transversely to said rear quarter laterally to said slot.

6. Boot according to claim 4, wherein said rod passes through said wedge-like element, its ends passing at a first slot and at a second slot arranged facing each other and provided respectively longitudinally to said rear quarter and to said flap.

7. Boot according to claim 4, wherein said rod passes through said wedge-like element, its ends passing at a first slot and at a second slot arranged facing each other and provided respectively longitudinally to said rear quarter and to said flap, said rod being articulated, at said first slot, to said eccentric lever and is connected, at said second slot, to a lug protruding on the side opposite to said wedge-like element.

8. Boot according to claim 1, wherein said means for the translatory motion of said wedge-like element comprise a threaded rod extending longitudinally on said rear quarter and rotatably supported thereby, said threaded rod rotatably engaging in a threaded seat defined by said wedge-like element, with said rod there being rigidly associated an actuation wheel accessible outside said boot, means being provided to prevent the rotation of said wedge-like element with respect to said rod.

9. Rear-entry ski boot with heel securing device comprising:

a shell at least one rear quarter articulated to said shell and defining lateral inner surfaces and a rear inner surface, a heel region defined by said rear inner surface, and means for exerting pressure on a skiers heel comprising;

at least one wedge-like element located at said heel region of said rear inner surface, a plurality of elastically deformable wings protruding from said wedge-like element and being located adjacent said lateral inner surfaces of said rear quarter, and translation means adapted for permitting movement of said wedge-like element with respect to said rear inner surface and movement of said plurality of elastically deformable wings with respect to said lateral inner surfaces.

10. Rear entry ski boot according to claim 9, wherein said translation means comprise pushbutton means interposed between said plurality of elastically deformable wings and said lateral inner surfaces of said rear quarter.

11. Rear entry ski boot according to claim 10, wherein said pushbutton means comprise a plurality of slots formed in said rear quarter, and and a plurality of pushbuttons, said plurality of pushbuttons being constituted by at least one pushbutton connected to each wing in said plurality of elastically deformable wings, each slot in said plurality of slots accommodating at least one of said pushbuttons.

12. Rear entry ski boot according to claim 9, wherein said translation means comprise pushbutton means interposed between said plurality of elastically deformable wings and said lateral inner surfaces, and positioning means cooperating with said pushbutton means, said pushbutton means comprising a plurality of slots formed in said rear quarter, and a plurality of pushbuttons, said plurality of pushbuttons being constituted by at least one pushbutton connected to each wing in said plurality of elastically deformable wings, each slot in said plurality of slots accommodating at least one of said pushbuttons.

13. Rear entry ski boot according to claim 12, wherein said positioning means comprise a plurality of raised portions protruding from said elastically deformable wings adjacent said pushbuttons, and a plurality of seats formed in said lateral inner surfaces adjacent said slots, said raised portions being releasably accommodatable in said seats for positioning said pushbuttons within said slots.

14. Rear entry ski boot according to claim 9, wherein said translation means comprise:

at least one slot formed in said rear quarter, a plurality of transverse teeth formed on said rear quarter adjacent said slot, at least one rod extending through said slot and having at least one end and at least one other end, said at least one end of said rod being connected to said wedge-like element, and at least one eccentric lever articulated to said other end of said rod and interacting with at least one tooth of said plurality of teeth for releasably positioning said wedge-like element at a desired position along said slot.

15. Rear entrance ski boot according to claim 9, wherein said plurality of elastically deformable wings comprises at least two elastically deformable wings, and wherein said shell has connected thereto at least one rear flap, said rear flap being located between said at least two elastically deformable wings within said heel region of said rear quarter and having at least one tab, said tab cooperating with said wedge-like element for distributing pressure generated by said means for exerting pressure on a skiers heel.

16. Rear entry ski boot according to claim 9, wherein said translation means comprise;

at least one threaded rod rotatably supported by said rear quarter, actuation means connected to said threaded rod, said actuation means being adapted for permitting said threaded rod to be rotated with respect to said rear quarter, a threaded seat rigidly associated with said wedge-like element and engaging said threaded rod, and means for preventing rotation of said wedge-like element with respect to said quarter, whereby said wedge-like element is caused to translate axially along said threaded rod, upon rotation thereof by said actuation means.

17. Rear entry ski boot according to claim 16, wherein said means for preventing rotation of said wedge-like element with respect to said quarter are defined by at least one side of said wedge-like element, said at least one side of said wedge-like element engaging said rear inner surface of said rear quarter, in sliding contact engagement relationship therewith.

18. Rear entry ski boot according to claim 16, further comprising at least one port, said port being formed in said rear quarter and permitting access to said actuation means.

* * * * *